US006591587B2

(12) United States Patent
Salm et al.

(10) Patent No.: US 6,591,587 B2
(45) Date of Patent: Jul. 15, 2003

(54) PROCESS AND APPARATUS FOR PACKAGING FLAT ARTICLES

(75) Inventors: Thomas Salm, Aachen (DE); Bernfried Kutsch, Stolberg (DE)

(73) Assignee: Winkler + Duennebier AG, Neuwied (DE)

( * ) Notice: Subject to any disclaimer, the term of this patent is extended or adjusted under 35 U.S.C. 154(b) by 87 days.

(21) Appl. No.: 09/738,221

(22) Filed: Dec. 15, 2000

(65) Prior Publication Data

US 2001/0005972 A1 Jul. 5, 2001

(30) Foreign Application Priority Data

Dec. 23, 1999 (DE) ..... 199 62 302

(51) Int. Cl.[7] ..... B65B 49/00; B65B 35/30
(52) U.S. Cl. ..... 53/461; 53/218; 53/447
(58) Field of Search ..... 53/446, 447, 456, 53/458, 462, 540, 541, 542, 544, 566, 251, 389.1, 374, 461, 218

(56) References Cited

U.S. PATENT DOCUMENTS 3,585,776 A * 6/1971 Euwe ..... 52/207
3,986,319 A * 10/1976 Puskarz et al. ..... 53/207
5,295,623 A * 3/1994 Bacques et al. ..... 229/109
5,791,124 A * 8/1998 Spatafora ..... 53/444
5,810,487 A * 9/1998 Kano et al. ..... 101/483
6,145,281 A * 11/2000 Hansen et al. ..... 414/789.6
6,279,301 B1 * 8/2001 Corniani et al. ..... 493/80

FOREIGN PATENT DOCUMENTS

FR 2 285 301 * 9/1974 ..... B65B/25/14
WO WO 96/20869 7/1996

* cited by examiner

*Primary Examiner*—Rinaldi I. Rada
*Assistant Examiner*—Paul Durand
(74) *Attorney, Agent, or Firm*—W. F. Fasse; W. G. Fasse

(57) ABSTRACT

Flat stacked articles 2, such as envelopes or packaging bags, and packaging blanks 5 are supplied to a packaging station 6, toward one another in offset parallel directions 4 and 15. Then, the stack 3 is moved into the packaging station 6 in an intake direction 17 transverse to the original transporting direction 4 of the articles 2 and, in the packaging station 6, is set down in the packaging blank 5. The stack 3 is then packaged in the packaging blank 5 in two processing positions 7, 8 of the packaging station 6, whereupon the packaged stack is discharged from the packaging station 6 in a discharge direction 11 parallel to the intake direction 17 and transverse to the original transporting direction 4 of the articles 2. The next respective packaging blank 5 is fed to the first processing position 7 in the direction 15 over the packaged stack 10 in the second processing position 8.

14 Claims, 2 Drawing Sheets

PROCESS AND APPARATUS FOR PACKAGING FLAT ARTICLES

FIELD OF THE INVENTION

The invention relates to a process and an apparatus for packaging flat, stacked articles, in particular envelopes, packaging bags and the like. First, the flat articles coming from a production machine are stacked and then at least partially packaged in a packaging station, using packaging blanks, and subsequently are transported further and discharged from the packaging station.

BACKGROUND INFORMATION

A process and apparatus of the abovementioned type are known in principle and are used for packaging envelopes and the like. This operation usually takes place satisfactorily, but the object of the invention is both to increase the number of articles which can be packaged per unit of time and to achieve this with a process and an apparatus which take up as little space as possible.

SUMMARY OF THE INVENTION

The above object has been achieved according to the invention in a process and in an apparatus for packaging flat articles.

In concrete terms, the invention provides that, on their way to the packaging station, the articles, in the form of stacks, and the packaging blanks first of all are moved towards one another in a state in which they are offset parallel to one another, that the flat articles, in order to reach the packaging station, are then transported transversely to their original transporting direction and then are set down on a packaging blank. Subsequently, the stacked articles are packaged in the packaging blank at two processing positions of the packaging station in order to form a pack, whereupon the pack is discharged from the packaging station transversely to the original transporting direction of the article. The next packaging blank in each case is basically fed to the first processing position of the packaging station over the pack, containing the packaged articles, and/or over the second processing position.

The use of two processing positions in the packaging station results in an increase in the number of articles which can be packaged per unit of time. The next stack in each case can be set down on a packaging blank even when the preceding stack is not yet fully packaged into its pack form.

The operation of supplying the packaging station with new packaging blanks in each case takes place over the second processing position and/or over the last-completed pack. This renders possible a particularly space-saving arrangement of the various components of the apparatus.

BRIEF DESCRIPTION OF THE DRAWINGS

The invention is described in more detail hereinbelow with reference to an exemplary embodiment which is illustrated in the drawing, in which.

DETAILED DESCRIPTION OF THE INVENTION

Figure 1:
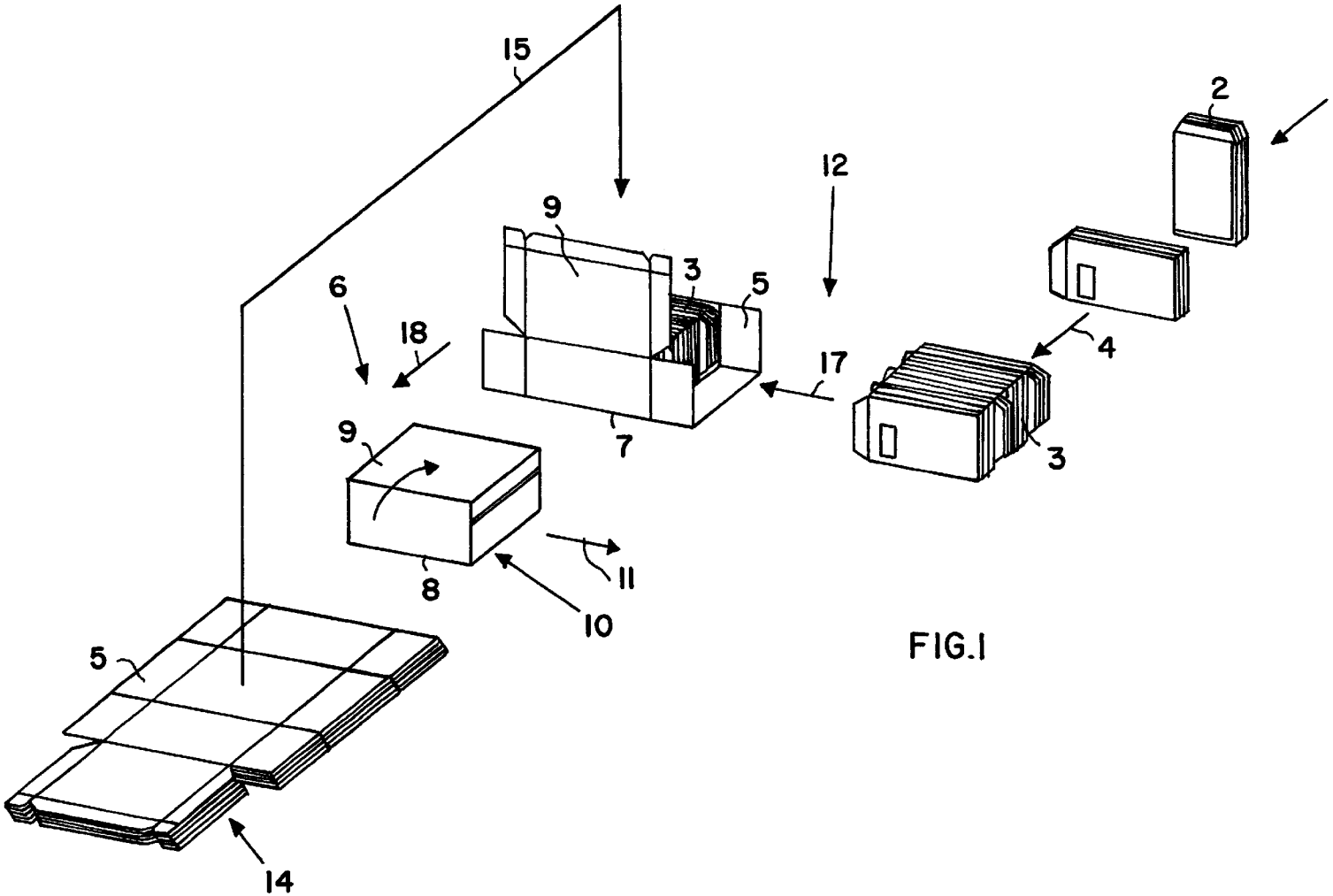
FIG. 1 shows a basic sketch of the process.
Figure 2:
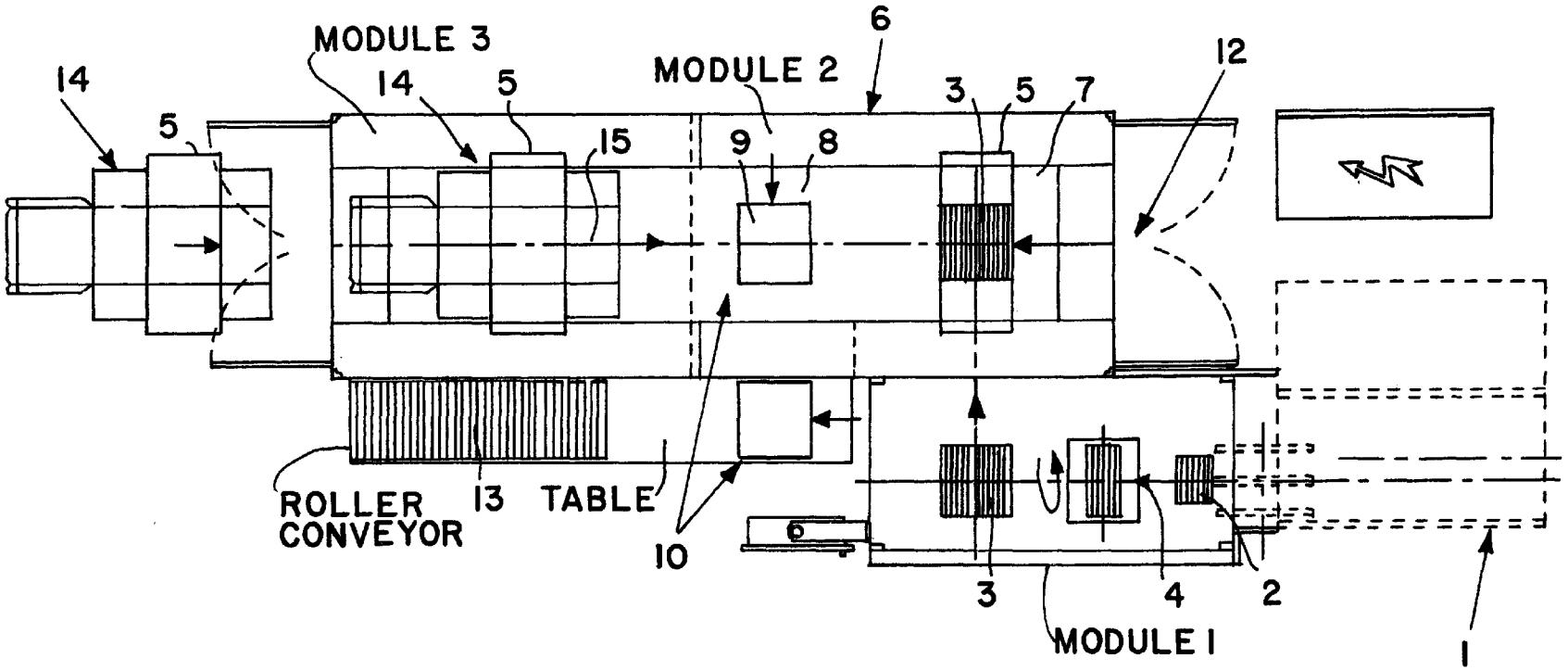
FIG. 2 shows a plan view of the apparatus.

The articles 2 such as envelopes and the like are supplied for example, individually from a production machine 1 along a supply path in a supply direction 4 or transport direction 4, and are first of all stacked and then, in the form of stacks 3, moved along an intake path in an intake direction 17 transversely to their original transporting direction 4 and set down on a packaging blank 5 in a packaging station 6. The packaging station 6 has two processing positions 7 and 8. In the first processing position 7, the stack 3 is partially packaged in the packaging blank 5 and, is then transferred to the second processing position 8 along a transfer path in a transfer direction 18. In the second processing position 8, the stack 3 is then fully packaged into the form of pack 10 for example by a cover part 9 being placed in position and closed. The pack 10 is then, in turn, discharged from the packaging station 6 along a discharge path in a discharge direction 11 transversely to the original transporting direction 4 and parallel to the intake direction 17, i.e. in the direction of the arrow 11 in FIG. 1, and then leaves the apparatus 12, for example, via a roller conveyor 13, once again parallel to the supply direction 4.

As can be seen, in particular, from the basic sketch of FIG. 1, a stack 14 of packaging blanks 5 is located in the apparatus 12. The respectively uppermost packaging blank 5 of the stack 14 has to be fed to the processing position 7 of the packaging station 6. This takes place along the blank feed path in a blank feed direction 15 shown by the arrow 15.

The stack 14 is raised, if appropriate, in its entirety, whereupon the respectively uppermost packaging blank 5 is transported to the processing position 7 over the processing position 8 and/or over a pack 10 located there, and lowered there onto an underlying surface. In the processing position 7, the packaging blank 5 assumes a position in which the stack 3, comprising articles 2, can be pushed onto it or set down on it. FIG. 1 shows the packaging blank 5 in a position in which it already partially encloses the stack 3.

In the processing position 7, the stack 3 is not just placed in a precisely positioned manner on the base of the packaging blank 5; it is also the case here that the side flaps of the packaging blank 5 are folded against the stack 3 and fixed. In the position 7, the package is thus completed apart from the cover.

From the processing position 7, the partially packaged stack 3 is then displaced into the processing position 8 and there, or on the way there, the cover part 9 is moved into the closed position. It is also expediently fixed there. Finally, the packaged stack 3, in the form of pack 10, is discharged from the second processing position 8 of the packaging station 6.

The blanks 5 and the articles 2 move basically toward one another in a state in which they are offset parallel to one another respectively in the blank feed direction 15 and the supply direction 4. In this case, the blanks 5 are first of all raised from an initial stack height, then moved horizontally, over the processing position 8, to above the processing position 7 and lowered there to the level of the stack 3. The partially packaged stack 3 moves from the processing position 7 into the processing position 8 in the transfer direction 18 parallel to the movement direction 15 of the packaging blanks 5, which are fed to the processing position 7 horizontally above the processing position 8. The completed pack 10 is discharged from the packaging station 6 in the discharge direction 11 transversely to the movement direction 18 of the not yet completed pack moving into the processing position 8 from the processing position 7.

What is claimed is:

1. A process of packaging flat articles in a package formed of a packaging blank, in a packaging station having first and second processing positions that are laterally displaced from one another, said method comprising the steps:

a) providing a stack of said flat articles;

b) providing said packaging blank;

c) moving said packaging blank in a blank feed direction along a blank feed path above said second processing position, so that said packaging blank crosses over said second processing position, and bringing said packaging blank into said first processing position;

d) moving said stack of said flat articles in a stack intake direction along a stack intake path into said first processing position and onto said packaging blank in said first processing position;

e) moving said stack of said flat articles and said packaging blank together in a transfer direction along a transfer path from said first processing position into said second processing position;

f) processing said packaging blank in at least one of said first and second processing positions to form of said packaging blank an at least partially closed and at least partially completed package containing said stack of said flat articles; and g) moving said package containing said stack of said flat articles in a discharge direction along a discharge path from said second processing position, wherein said discharge path is parallel to and laterally offset from said stack intake path.

2. The process according to claim 1, wherein said stack intake direction and said discharge direction are oriented opposite each other.

3. The process according to claim 1, wherein said blank feed path is parallel to and vertically offset from said transfer path.

4. The process according to claim 3, wherein said transfer direction and said blank feed direction are oriented opposite each other.

5. The process according to claim 1, wherein said step a) of providing said stack comprises supplying said flat articles in a supply direction along a supply path and forming a stack thereof at a stacking station, said step d) comprises moving said stack from said stacking station to said first processing position, said supply path is parallel to and offset from said blank feed path and transverse relative to said stack intake path, and said supply direction and said blank feed direction are oriented opposite each other.

6. The process according to claim 1, further comprising, after said step g), a step of moving said package containing said stack of said flat articles in an exit direction along an exit path, wherein said exit path is parallel to and offset from said blank feed path, and wherein said exit direction and said blank feed direction are oriented opposite each other.

7. The process according to claim 1, wherein said processing of said packaging blank in said step f) comprises folding up side flaps of said packaging blank against said stack in said first processing position.

8. The process according to claim 7, wherein said processing of said packaging blank in said step f) further comprises folding a cover part of said packaging blank onto said stack so as to close said package in said second processing position.

9. An apparatus for packaging flat articles in a package formed of a packaging blank, said apparatus comprising:

a stacking station in which said flat articles are stacked to form a stack of said flat articles;

a packaging blank supply station adapted to supply successive ones of said packaging blanks;

a packaging station, which includes first and second processing positions that are laterally displaced from one another, and which is adapted to process a respective said packaging blank to form thereof a package containing said stack of said flat articles;

a stack intake path, which extends from said stacking station to said first processing position, and along which said stack of said flat articles can be moved from said stacking station to said first processing position;

a blank feed path, which extends from said packaging blank supply station, over said second processing position, to said first processing position, and along which a respective one of said packaging blanks can be moved from said packaging blank supply station to said first processing position;

a transfer path, which extends from said first processing position to said second processing position, and along which said respective packaging blank and said stack can be moved together from said first processing position to said second processing position; and a discharge path, which extends from said second processing position, and which is parallel to and laterally offset from said stack intake path, and along which said package containing said stack of said flat articles can be discharged from said second processing position.

10. The apparatus according to claim 9, wherein said discharge path is on the same side of said packaging station relative to said second processing position, as is said stack intake path relative to said first processing position.

11. The apparatus according to claim 9, wherein said blank feed path is parallel to and vertically offset from said transfer path.

12. The apparatus according to claim 11, wherein said packaging blank supply station is located on a side of said packaging station adjacent to said second processing position and away from said first processing position.

13. The apparatus according to claim 9, further comprising a supply path leading to said stacking station, along which said flat articles can be supplied to said stacking station, wherein said supply path is parallel to and offset from said blank feed path, and transverse relative to said stack intake path.

14. The apparatus according to claim 9, further comprising an exit conveyor extending from said discharge path, in a direction parallel to, offset from and oppositely oriented relative to said blank feed path.

* * * * *